US009315965B1

(12) United States Patent
Adler et al.

(10) Patent No.: US 9,315,965 B1
(45) Date of Patent: Apr. 19, 2016

(54) FLOOD CONTROL SYSTEM PANELS FOR SUBWAY ENTRANCE

(71) Applicant: RSA PROTECTIVE TECHNOLOGIES, LLC, Claremont, CA (US)

(72) Inventors: Richard S. Adler, Claremont, CA (US); David Toyne, Tujunga, CA (US)

(73) Assignee: RSA PROTECTIVE TECHNOLOGIES, LLC

( * ) Notice: Subject to any disclaimer, the term of this patent is extended or adjusted under 35 U.S.C. 154(b) by 0 days.

(21) Appl. No.: 14/295,074

(22) Filed: Jun. 3, 2014

Related U.S. Application Data

(60) Provisional application No. 61/996,642, filed on May 12, 2014, provisional application No. 61/996,103, filed on Apr. 28, 2014, provisional application No. 61/961,046, filed on Oct. 2, 2013, provisional application No. 61/956,204, filed on Jun. 3, 2013, provisional application No. 61/855,540, filed on May 16, 2013.

(51) Int. Cl.

| | |
|---|---|
| ***E04H 9/04*** | (2006.01) |
| ***E02D 29/14*** | (2006.01) |
| ***E02B 7/20*** | (2006.01) |
| ***E04H 9/12*** | (2006.01) |
| ***E04H 9/14*** | (2006.01) |
| ***E04H 9/16*** | (2006.01) |
| ***E06B 5/10*** | (2006.01) |

(52) U.S. Cl.
CPC ..... *E02D 29/149* (2013.01); *E02B 7/20* (2013.01); *E02D 29/1427* (2013.01); *E04H 9/04* (2013.01); *E04H 9/12* (2013.01); *E04H 9/14* (2013.01); *E04H 9/145* (2013.01); *E04H 9/16* (2013.01); *E06B 5/10* (2013.01)

(58) Field of Classification Search
CPC ..... E04H 9/04; E04H 9/12; E04H 9/14; E04H 9/145; E04H 9/16; E02B 7/20; E02D 29/14; E02D 29/1427; E02D 29/149; E06B 5/10
USPC ..... 52/169.6
See application file for complete search history.

(56) References Cited

U.S. PATENT DOCUMENTS

| | | | | | |
|---|---|---|---|---|---|
| 2,946,215 | A * | 7/1960 | Eshbaugh et al. | 70/169 | |
| 4,351,446 | A * | 9/1982 | Madden | 220/210 | |
| 4,535,908 | A * | 8/1985 | Dabich | E02D 29/1418 | 16/375 |
| 5,950,368 | A * | 9/1999 | Bradford | E02D 29/1418 | 220/484 |
| 6,260,312 | B1 * | 7/2001 | Spene | E04H 9/12 | 52/169.1 |
| 6,263,637 | B1 * | 7/2001 | Spene | E04H 9/12 | 52/169.6 |
| 6,266,863 | B1 * | 7/2001 | Spene | E04H 9/12 | 29/416 |
| 6,539,674 | B2 * | 4/2003 | Arnold | E04H 9/06 | 109/15 |
| 6,772,566 | B1 * | 8/2004 | Machledt et al. | 52/169.6 | |
| 6,951,318 | B1 * | 10/2005 | Petersen | E02D 29/1427 | 220/315 |
| 7,261,332 | B1 * | 8/2007 | Petersen | E02D 29/1427 | 292/121 |
| 7,690,159 | B1 * | 4/2010 | Arnold | A01K 1/0035 | 108/35 |

(Continued)

*Primary Examiner* — Andrew J Triggs
(74) *Attorney, Agent, or Firm* — Stephen J. Lieb; Frommer Lawrence & Haug LLP

(57) ABSTRACT

A cover system for covering an entrance of an underground structure. The cover system comprises a frame structure attached to a foundation of the entrance; and a seal gasket configured to provide a seal between the frame structure and the foundation and between the frame structure and a panel of the cover system. The panel further includes a plurality of engagement members that engage the panel with the frame structure.

12 Claims, 15 Drawing Sheets

(56) References Cited

U.S. PATENT DOCUMENTS 7,866,915 B2 * 1/2011 Pendleton ..... E02D 29/14 404/25
7,891,904 B2 * 2/2011 Stadler ..... E02D 29/1427 404/25
8,176,692 B2 * 5/2012 Crow ..... E04H 9/06 52/169.6
8,511,005 B2 * 8/2013 Crow ..... E04H 9/06 52/169.6
2003/0172596 A1 * 9/2003 Talley et al. ..... 52/19
2007/0022678 A1 * 2/2007 Sempel ..... 52/169.6

* cited by examiner

FLOOD CONTROL SYSTEM PANELS FOR SUBWAY ENTRANCE

RELATED APPLICATIONS

This application claims benefit to provisional Application Nos. 61/956,204, filed on Jun. 3, 2013, 61/996,642 filed on May 12, 2014, 61/996,103, filed on Apr. 28, 2014, 61/961,046 filed on Oct. 2, 2013, 61/956,204, filed on Jun. 3, 2013 and 61/855,540, filed on May 16, 2013, the disclosures of all of which are incorporated herein by reference.

The disclosure of non-provisional application Ser. No. 14/295,052, titled "Removable Flood Control Cover System For Underground Facility Vents And Openings", filed on Jun. 3, 2014, is incorporated herein by reference.

BACKGROUND

The invention disclosed herein relates generally to a cover system for preventing water from entering underground facilities such as transportation facilities, storage facilities, vaults, data centers, basements, etc., through openings, e.g., for ventilation and/or ingress/egress.

Underground facilities, such as, but not limited to, those mentioned above, are under the threat of being flooded due to heavy rains, hurricanes, and storm surges, not only in areas traditionally prone to flooding close to rivers and shorelines, but also in metropolitan areas not traditionally flooded. For example, in 2012, The New York City subway system experienced unprecedented damage caused by storm surge and flood waters when Superstorm Sandy hit New York City. Parts of the NYC subway system were flooded, to a much lesser extent, at other times from torrential rains. Much of the flooding was caused by water entering the subway system through entrances and air vents.

SUMMARY

Embodiments presented in this application provide a cover system that covers and seals openings to low level or underground facilities (hereinafter referred to simply as "underground"). For example, such an opening may be at ground level. ("Ground level" is meant herein in a broad sense and encompasses levels near ground level, as well as at ground level. "Ground level" may also be used herein in a relative sense referring to the ground at the particular location of an opening, which may not be at ground level relative to the area nearby or surrounding the particular location. For example, a vent or entrance may be at sidewalk level, which is above street level, or above or below stairs, which are above or below a surrounding area, etc.) Such cover systems can substantially reduce the amount of water that might otherwise enter an underground facility due to ground water levels.

Some embodiments are directed to a cover system for covering an entrance opening of an underground facility. The cover system according to one or more of these embodiments comprises a waterproof panel and a seal gasket configured to extend peripherally relative to the panel and a frame attached to the inner periphery of the opening. Clamping devices are provided that engage the panel and the periphery of the opening and/or structure extending over and attached to the opening to clamp the panel over the opening and compress the seal gasket.

Some embodiments are directed to a cover system for covering an entrance of an underground structure. The cover system comprises a frame structure attached to a foundation of the entrance; and a seal gasket configured to provide a seal between the frame structure and the foundation and between the frame structure and a panel of the cover system. The panel further includes a plurality of engagement members that engage the panel with the frame structure.

According to some embodiments, the panel includes a plurality of openings that provide access to the engagement members. Each opening is covered by a lid with a seal gasket. The frame structure includes a plurality of rails with protrusions adapted to be inserted into receptacles in the foundation. The protrusions are detachable from the rails. The frame structure further includes a plurality of corner rails. The frame structure further includes a plurality of cross bars, each having a pressing member for pushing a corresponding rail against a foundation of the entrance. At least one rail includes a pressing member that pushes an adjacent rail against the foundation. The engagement member includes a toggle clamp. The toggle clamp includes a toggle part attached to a base that is attached to a surface plate of the panel. At least one toggle clamp includes a leg extending beyond a height of the toggle part. The seal gasket includes two angled flaps.

BRIEF DESCRIPTION OF DRAWINGS

To the accomplishment of the foregoing and related ends, certain illustrative embodiments of the invention are described herein in connection with the following description and the annexed drawings. These embodiments are indicative, however, of but a few of the various ways in which the principles of the invention may be employed and the present invention is intended to include all such aspects and their equivalents. Other advantages, embodiments and novel features of the invention may become apparent from the following description of the invention when considered in conjunction with the drawings. The following description, given by way of example, but not intended to limit the invention solely to the specific embodiments described, may best be understood in conjunction with the accompanying drawings, in which:

FIG. 18(*b*) illustrates a configuration of a toggle clamp according to an embodiment of the present application.

FIG. 19(*b*) illustrates an engagement between a toggle clamp and a rail according to an embodiment of the present application.

DETAILED DESCRIPTION

Embodiments of cover systems, components, and methods of installation are disclosed or are apparent from and encompassed by the description herein.

Figure 1:
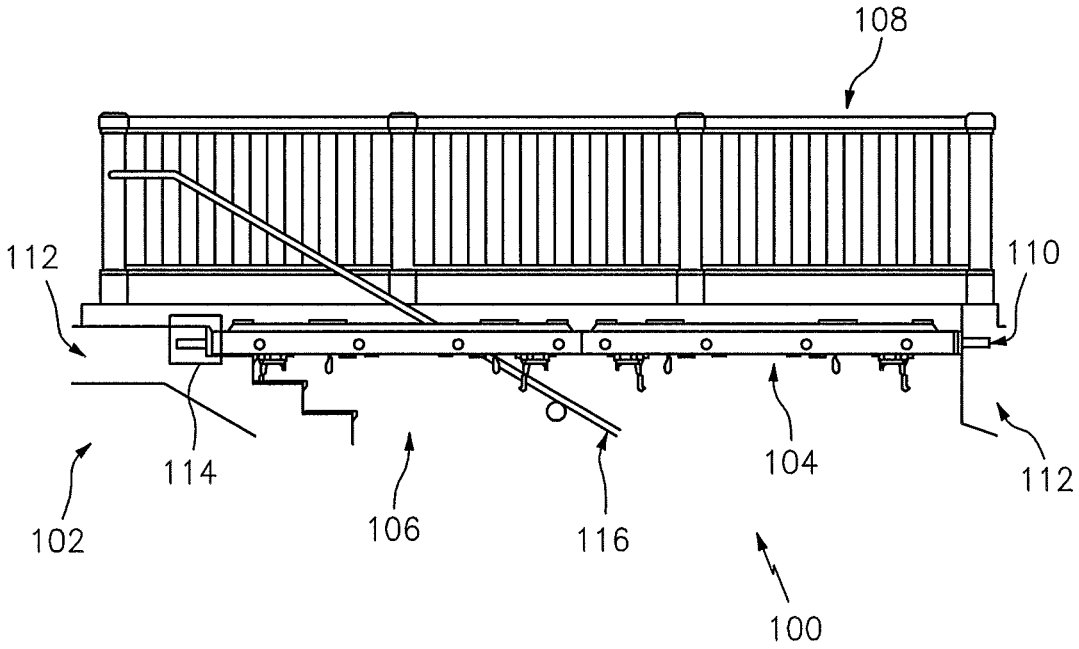
FIG. 1 illustrates a cover system installed at the entrance of a subway according to an embodiment of the present application.

FIG. 1 depicts a section view of an installed cover system 100 at an entrance 106 of an underground structure 102 according to an embodiment. The underground structure 102 may include a subway, a basement, a tunnel, a vault, and any other structures that below the street level. An opening 106 may be typically provided to an underground structure so that workers and instruments may be moved into the underground structure and or be removed from the underground structure. As an entrance to an underground structure, the opening 106 may be typically free of any screen or grates. Structures 108, such as safety guards, railing assemblies, and hand rails, may be installed around the periphery of the opening 106. A cover system of the opening 106 that prevents water from entering the underground structure needs to adapt to the existing configurations of the opening and may not substantially change the current structures.

The cover system 104 as set forth in the present application seals the opening of an underground structure as shown in FIG. 1. According to an embodiment, the cover system 104 is attached to the foundations 112 surrounding the underground opening. Any attaching means may be used, including glue, adhesive, bolts, nails, and screws. According to an embodiment, a plurality of receptacles 110 may be installed in the foundation 112. The cover system 104 includes a plurality of protrusions to be contained in the plurality of receptacles. The cover system 104 may be further attached to the foundation 112 by a plurality of cross bars that are inside the cover system 104 and pushes periphery rails of the cover system 104 against the foundation 112.

To provide a water seal between the cover system 104 and the foundation 112, a gasket is placed therebetween and is pressed by the cover system against the foundation to form a proper seal. The gasket may be placed around the periphery of the cover system 104 and conform to the general contour of the cover system 104. In addition, any other gaps between the cover system 104 and the foundation 112 and any other gaps of the cover system 104 are filled with water impermeable materials, such as room temperature vulcanizing silicones, caulks, foams, or adhesives.

As shown in FIG. 1, the cover system 104 may use the step 110 of the entrance as a support component. Although a handrail 116 is shown in FIG. 1, it may be removed before the installation of the cover system 104. According to an embodiment, the cover system 104 as shown in FIG. 1 is designed to provide a protection to the underground structure in at least a Category 2 storm event determined based on National Weather Service's storm surge model or Sea, Lake and Overall Surges Model from Hurricanes ("SLOSH). According to an embodiment, the cover system 104 is capable of resisting a high tide of approximately 18 feet.

Figure 2:
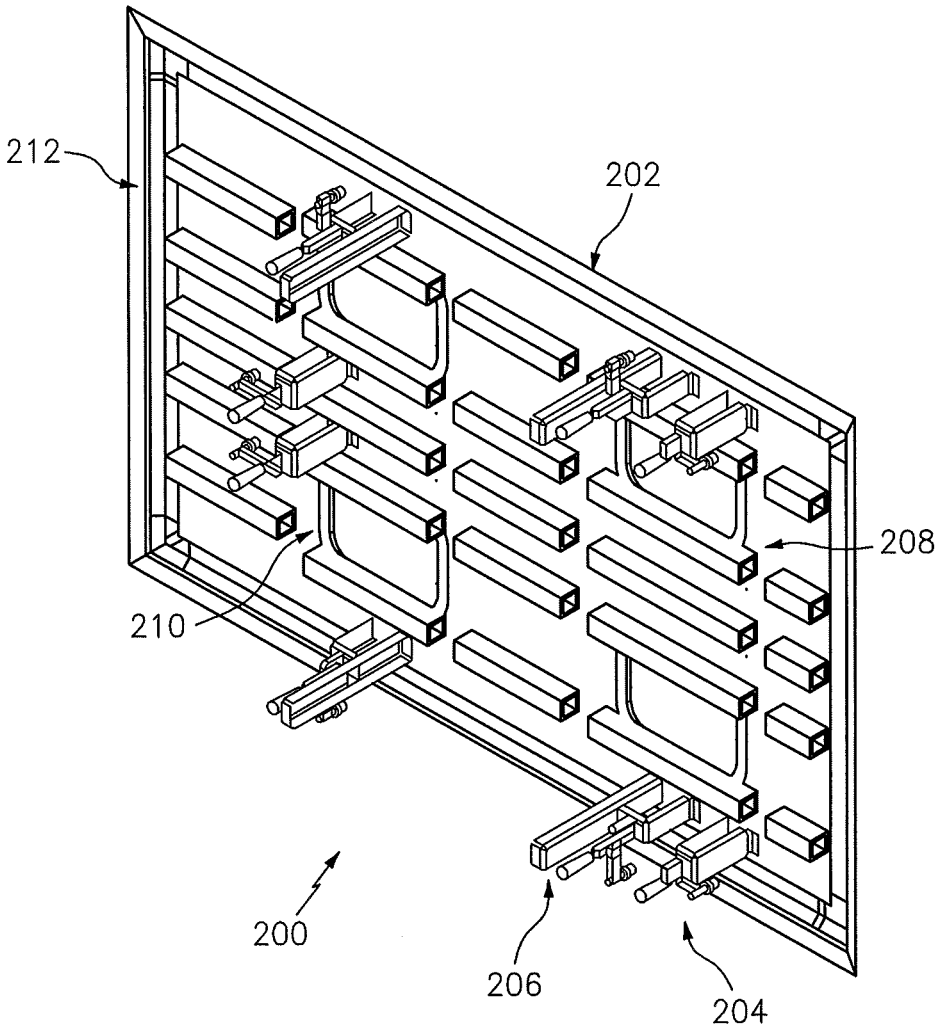
FIG. 2 illustrates a cover panel according to an embodiment of the present application.
Figure 3:
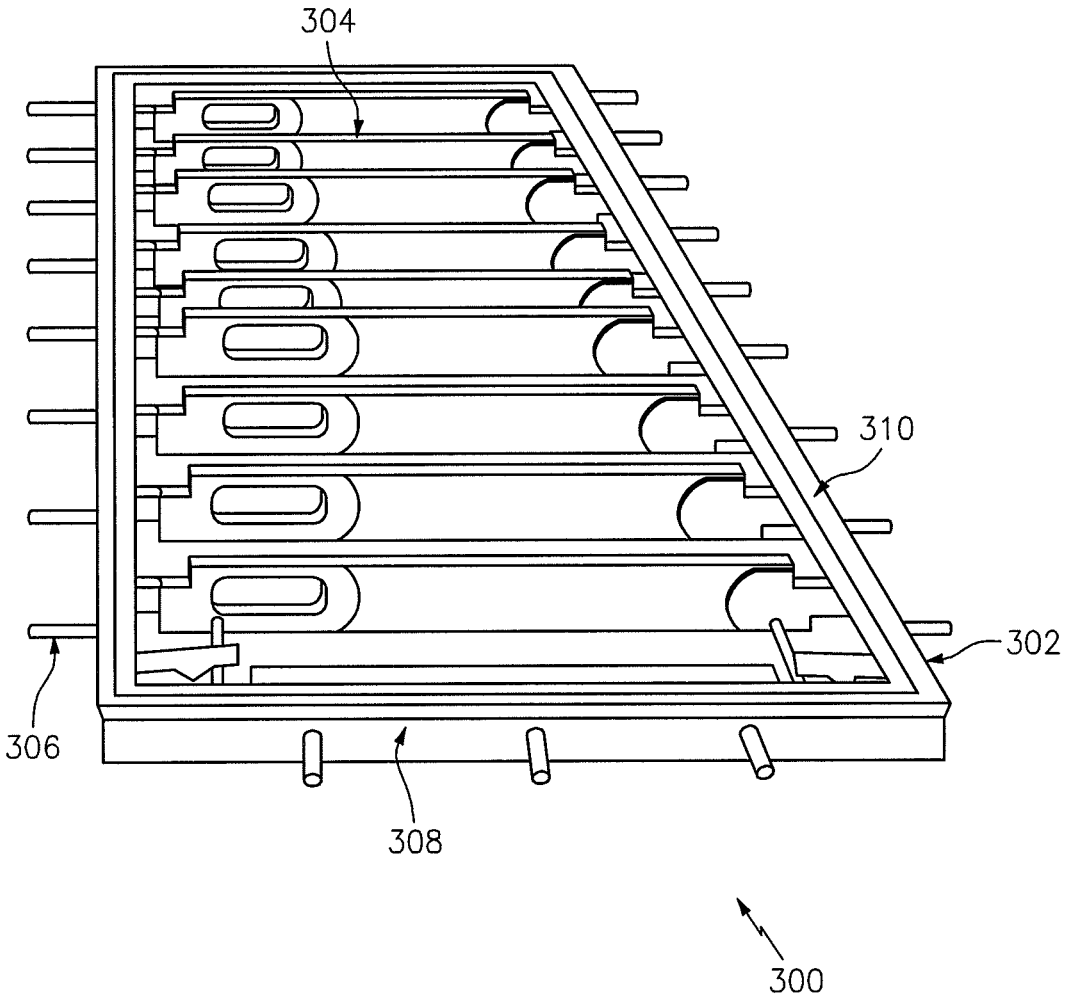
FIG. 3 illustrates a frame structure according to an embodiment of the present application.

The cover system 104 as shown in FIG. 1 may be divided into a panel portion as shown in FIG. 2, a frame portion as shown in FIG. 3, and a seal gasket as shown in FIGS. 4(*a*) and (*b*). Each portion will be discussed in detail in the following section of the present application.

FIG. 2 illustrates a panel 200 of the cover system 104 according to an embodiment of the present application. The panel 200 may be disengaged from the cover system 104 and stored separately from other components of the cover system. The detachable design of the panel 200 reduces the amount of weight of each part of the cover system and allows the cover system 104 to be handled manually, i.e. without using lifting machines such as cranes. Workers with regular physical strength would be able to install or disassemble the cover system 104. The detachability of the panel 200 may be achieved by a plurality of engagement means 204 and 206, which may be clamps, fasteners, screws, bolts, or ties.

According to an embodiment, the panel 200 includes a surface plate 202, a plurality of first toggle clamps 204, a plurality of second toggle clamps 206, a plurality of support members 208, a plurality of openings 210, and a plurality of edge reinforcements 212. The surface plate 202 is waterproof and substantially encloses an underground opening. The surface plate 202 may be made of a metal plate. The edges of the surface plates 202 may be enforced with additional members such as metal strips 212.

The support members 208 may be placed on top of at least a cross bar 304 of a frame structure 300 as shown in FIG. 3 and support the surface plate 202 such that the surface plate 202 may not have excessive deformation or damage due to the water pressure. According to an embodiment, the support members 208 may be arranged substantially along a longitudinal direction of the panel 200 and are supported by a plurality of cross bars 304. The support members 208 may be any structural members as long as they have suitable profiles determined by the distance between the surface plate 202 and the cross bars 304. The support members 208 may be tubular members or solid members.

The first toggle clamps 204 and the second toggle clamps 206 are used to clamp the panel 200 to the frame structure 304 of the cover system. Any engagement means, other than toggle clamps, may be used to secure the panel 200 on a frame structure. The engagement means may include bolts, toggles, ties, screws, adhesives, and clamps. The toggle clamps is configured to engage with the cross bars 304 in a manner to secure the panel 200 to the frame structure 300. The second toggle clamps 206, which have legs longer than the first toggle clamps 204, may also be used to support the panel 200 during storage or transportation.

The plurality of openings 210 provide access to the engagement members 206 and 204 such that installers operate the engagement members via the openings 310 to secure the panel to a frame structure. The plurality of openings may also be covered by a lid and a seal to prevent water from entering therethrough. The lid may be additionally secured to the surface plate 202 by screws, bolts, rivets, or any other proper means for securing purposes.

Any material that may provide structural strength may be used to make the panel 200, the surface plate 202, or any other components of the panel, including metal, stainless steel. Aluminum, alloy, and plastic. According to an embodiment, the surface plate is made of Alloy 6061-T6.

FIG. 3 illustrates a frame structure 300 according to an embodiment of the present application. The frame structure 300 is secured to the foundation 112 of an underground opening 106 and supports the panel 200. The frame structure 300 includes a plurality of rails, such as a plurality of longitudinal rails 310 and a plurality of end rails 308. A plurality of protrusions 306 may be provided to the rails 310 and 308. These protrusions may be inserted into receptacles 504 as shown in FIG. 5(*b*) installed in the foundation. The frame structure 300 further includes a plurality of cross bars 304, which are configured to push the rails against the foundation. The cross bars 304 may be arranged along the longitudinal direction or the cross direction of the frame structure 300. According to an embodiment, the cross bars 304 are preferably arranged along the cross direction. The cross bars 304 may be evenly distributed inside the frame structure to provide a uniform pressure against the foundation. According to an embodiment, one cross bar 304 is placed in the middle between every two protrusions 306.

A seal gasket 302 may be placed over the frame structure 300 to cover both the top and side surfaces of the frame structure. The panel 200, by way of this weight, the weight of water on top of it, and the pressure exerted by the engagement members, presses the seal gasket against the frame structure 300, thus forming a water tight seal between the panel 200 and the frame structure 300. The cross bars 304 presses the rails 310 and 308, which in turn push the seal gasket 302 against the foundation, thus forming a water tight seal between the rails and the foundation of an opening.

Figure 4A:
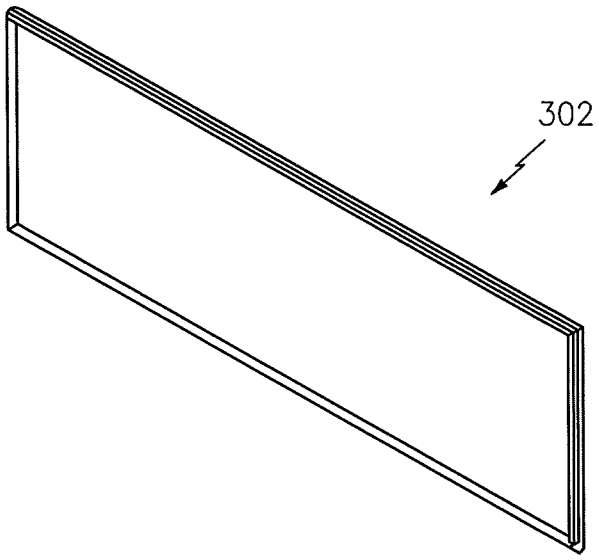
FIG. 4*a* illustrates a seal gasket according to an embodiment of the present application

FIG. 4*a* illustrates a general configuration of a seal gasket 302 according to an embodiment of the present application. The seal gasket 402 generally conforms to the contour of the frame structure or the underground opening and extends around the periphery of the frame structure 300. The seal gasket 302 may be made of any flexible or elastic material including rubber, foam, metal, and plastic. According to an embodiment, the seal gasket 302 is prefabricated before installation of the cover system 104 and then assembled with the panel and the frame structure on site. The seal gasket 302 may be in a form of a single connected rectangular piece that fits snugly behind and around the rails. According to an embodiment, the seal gasket 302 is formed on site by using any curable polymeric materials.

Figure 4B:
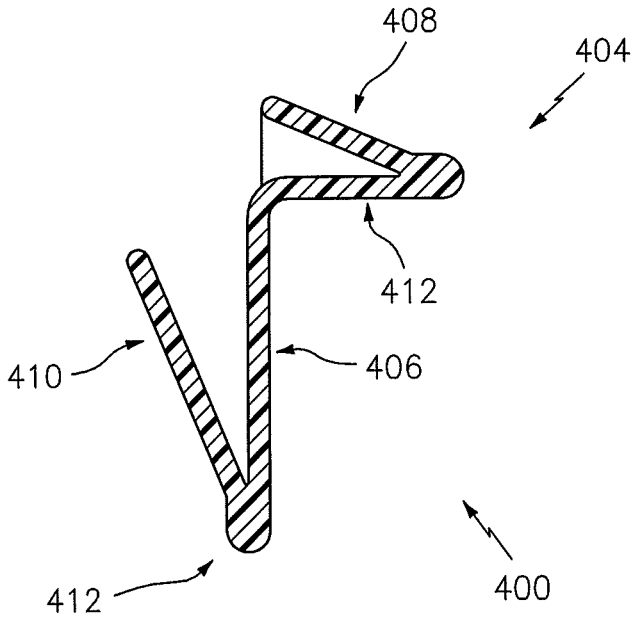
FIG. 4*b* illustrates a cross-section of a seal gasket according to an embodiment of the present application.

FIG. 4*b* illustrates a cross-section view of the seal gasket 302 according to an embodiment of the present application. The cross-section 400 includes a top portion 404 and a side portion 412. The top portion 404 includes a flat part 412 connected with a tilted part 408. The tilted part 408 forms an angle with the flat part 412 and is deformable in response to the pressure exerted by the panel 200. This angled flap 408 is capable of improving the watertight function between the panel 200 and the frame structure 300. The side portion 412 also includes a vertical part 406 and a tilted part 410. The tilted part 410 forms an angle with the vertical part 406 and is adaptable to the pressure exerted by the rails, thus forming an improved water seal like the top part 404. As shown in FIG. 4(*b*), the top part 404 and the side part 412 are integrated with each other and form a single piece. According to an embodiment, the two parts are separated from each other and may be applied or installed independently.

Figure 5A:
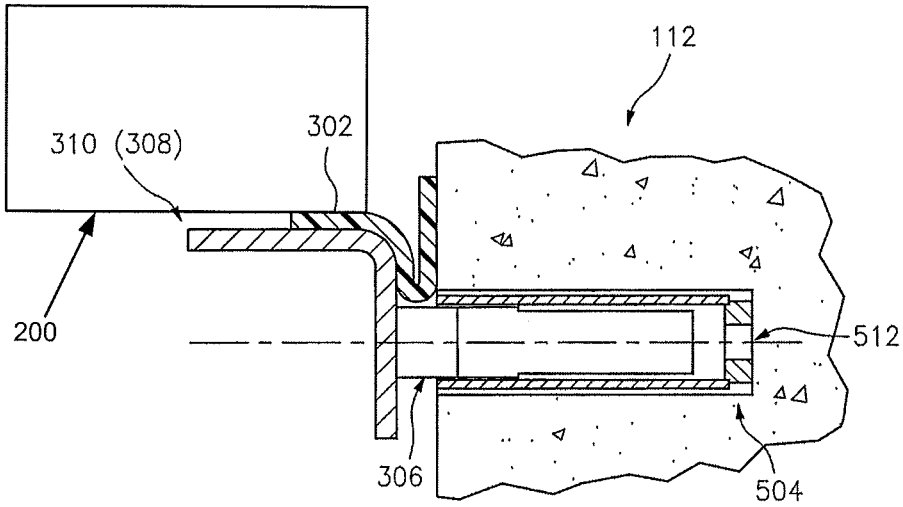
FIG. 5*a* illustrates an attachment and a seal gasket between a frame structure and a foundation according to an embodiment of the present application.

FIG. 5*a* illustrates the attachment and the seal between the cover system 104 and the underground opening 106. A plurality of receptacles 504 may be first installed in the foundation 112 of an underground opening 106. The receptacles may be a plurality of tubular members that are capable of holding an insertion. The receptacles may be secured to the foundation by any proper ways including anchors, adhesives, or self-expansion. According to an embodiment, the receptacles are attached in the foundation by epoxy. The rails 310 or 308 include a plurality of protrusions 306 that are inserted into the receptacles 504. The insertion may be temporary or may be permanent. The protrusions are preferably to be slidable inside the receptacles 504, which allow the rails 310 or 308 to get closer to the foundation 112. The seal gasket 302 is place above the receptacles 504 and is pressed between the rails 310 or 308 and the foundation 112, thus preventing water from entering or seeping through any gaps between the rails and the foundation. According to an embodiment, the receptacles 504 further include a retaining mechanism 512 adaptable to accept and retain an enclosure structure that covers the receptacle.

Figure 5B:
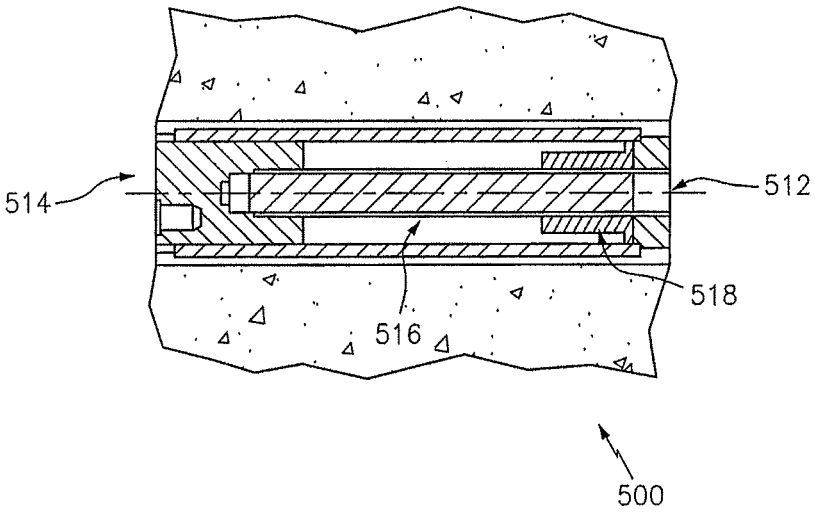
FIG. 5*b* illustrates a pin covered by a cap according to an embodiment of the present application.

FIG. 5*b* illustrates a receptacle 504 that has a cap 514 according to an embodiment of the present application. When the cover system 104 is not installed, the receptacles 504 need to be enclosed to prevent external objects from clogging the receptacles. In an embodiment, the receptacle 500 is covered by a cap 514. To maintain the cap 514 in a proper position, the cap 514 is attached to an extension 514 and a stopper 518. The extension 514 and the stopper are attached to each other in a way to allow the distal end of the extension part fit properly inside the retaining mechanism 512. The cap 514 may be attached to the proximal end of the extension part 516 by thread or welding or any other suitable ways.

Figure 6:
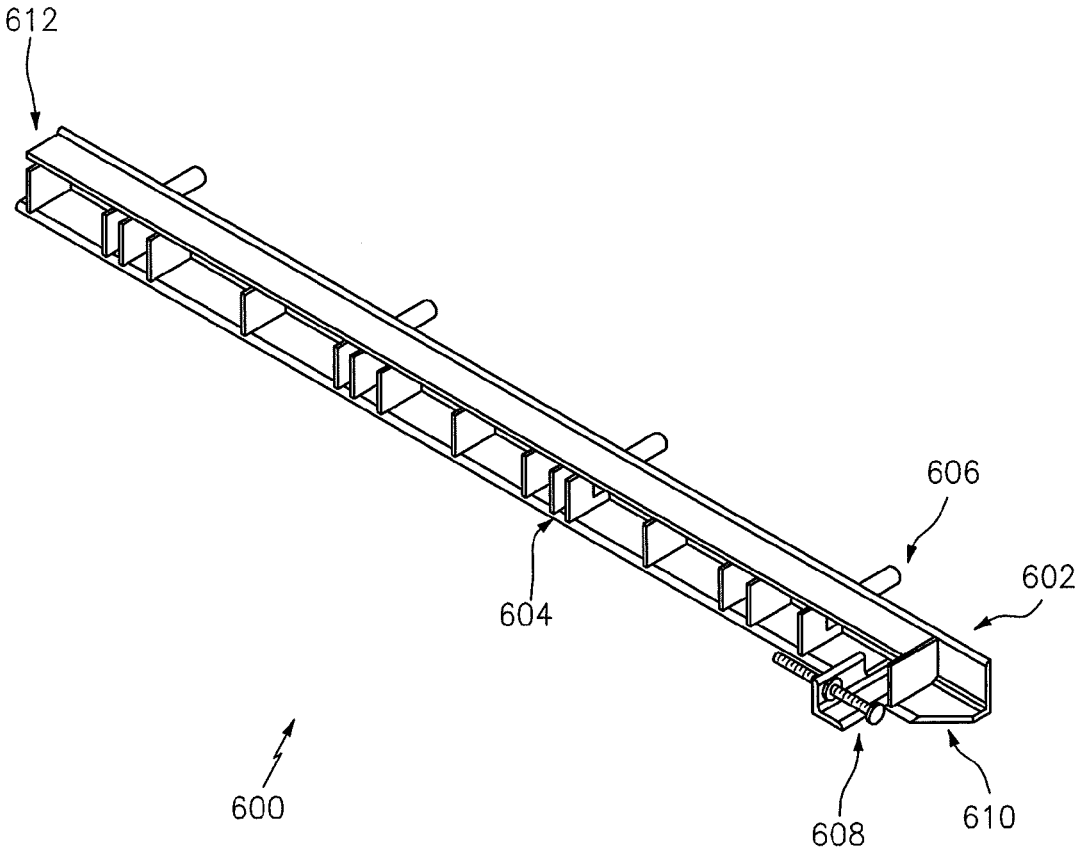
FIG. 6 illustrates a rail of a frame structure according to an embodiment of the present application.

FIG. 6 illustrates a rail 600 according to an embodiment of the present application. The rail 600 may be used as the longitudinal rails 310 or the end rails 308 as shown in FIG. 3. The rail 600 is configured to be attached to a foundation of an underground opening and support a panel portion. The rail 600 may be of any shape or configuration as long as it provides adequate contact areas for the panel. The rail 600 may be made of any material with proper strength.

According to an embodiment, the rail represents a tubular member having an open or closed cross-section. The rail 600 may be formed by attaching a plurality of plates or strips made of metals, alloys, aluminum, or plastic. The rail 600 includes a first end 602, a second end 612, a plurality of protrusions 606, a plurality of reinforcement ribs 604, and a pressing member 608 at the 602. The first end 602 may be beveled at its lower portion 610, where the rail meets with another one. The plurality of protrusions 606 may be formed integrally with the rail by welding, adhesive, or any other proper ways. The protrusions may also be detachably attached to the rail 600. According to an embodiment, the protrusion 606 represents a pin or a bar that is inserted into a socket 704 of the rail as shown in FIG. 7(*b*). The reinforcement ribs 604 are placed adjacent to the sockets 704 to reinforce the sockets and prevent them or the protrusions or the surrounding plates from being damaged by the weight of the water load of the panel 200.

According to an embodiment, cross bars 304 are used in a frame structure to push longitudinal rails 310 against the foundation. To engage the end rails along the cross direction with the foundation, a pressing member 608 is added to the longitudinal rails. The pressing member 608 is adapted to move along a direction parallel to that of the rail 600. After the rail 600 is firmly secured in position by the cross bars, the press member 608 is operated to exert pressure on an adjacent rail, such as an end rail, thus pressing that rail against the seal gasket and the foundation.

Figure 7A:
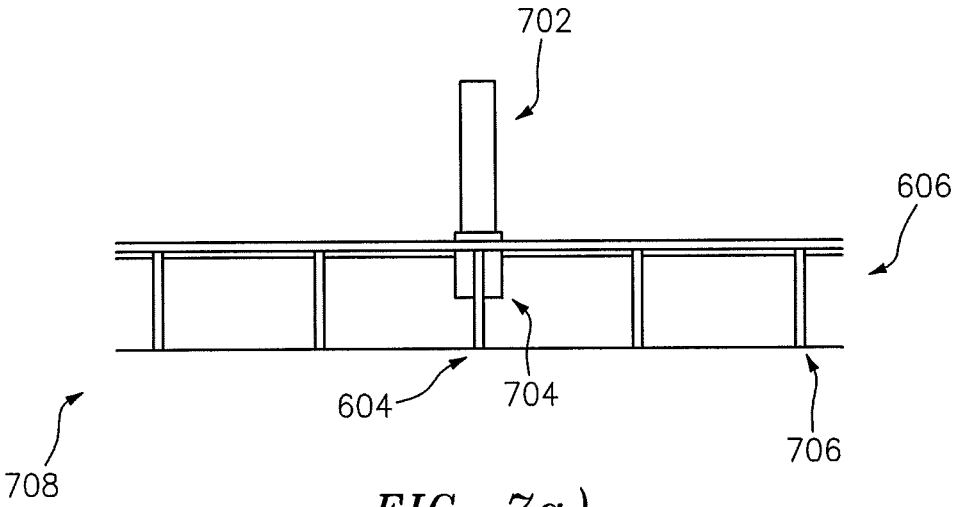
FIG. 7*a* illustrates an attached pin according to an embodiment of the present application.
Figure 7B:
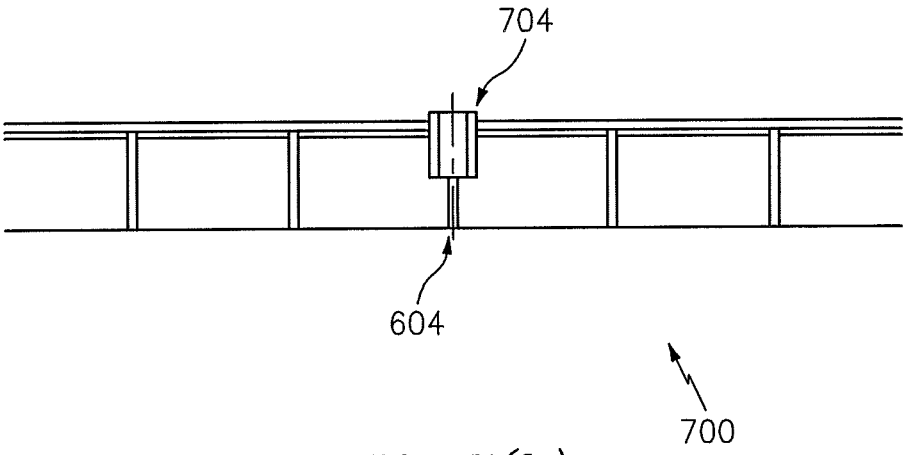
FIG. 7*b* illustrates a socket on a rail to accept a pin according to an embodiment of the present application.

FIG. 7*a* illustrates the protrusion 606 on a rail according to an embodiment of the present application. A socket 704 is secured to the rail 708. A reinforcement rib 604 is also used to enhance the attachment. In addition to the rib 604, a plurality of ribs 706 may be attached to the rail 708 to enhance the mechanical strength of the rail. The socket 704 may be secured to the rail by welding, screws, bolts, or rivets. According to an embodiment, the socket 704 flushes with the surface of the rail 708 to have a smooth contact area with the seal gasket. The protrusion 606 may be a solid bar or a hollow pin that is permanently attached to the socket 704. FIG. 7*b* illustrates a socket 704 after the protrusion 702 is removed. According to an embodiment, the protrusion 702 may be removable from the socket 704.

Figure 8:
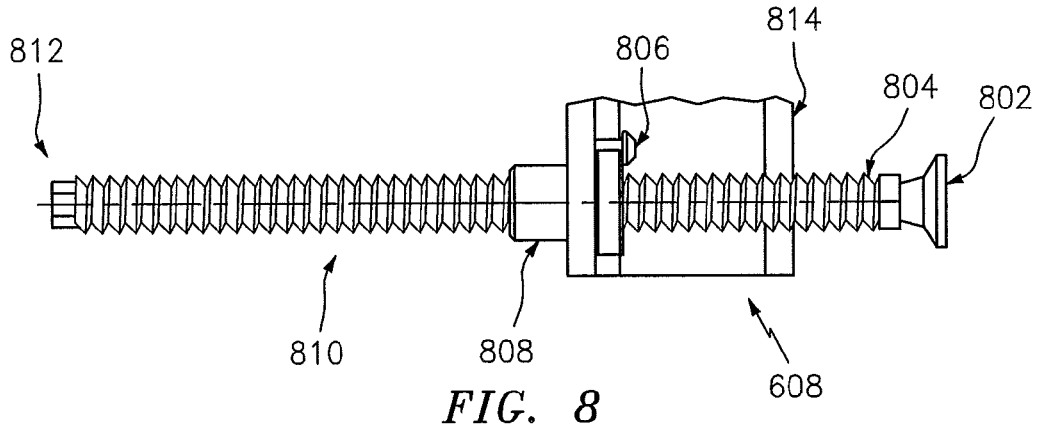
FIG. 8 illustrates a pressing member according to an embodiment of the present application.

FIG. 8 illustrates a pressing member 608 according to an embodiment of the present application. An extension member 814 attaches the pressing member 608 with the rail 600. The extension member 814 is configured to be perpendicular to the rail such that the attached pressing member 608 has a movement parallel to the rail. The pressing member 800 includes a shaft 810 having a free end 812 and a contact end 804. The free end 812 has a configuration for engaging with a tool, such as a screw driver or a socket driver, for operating the shaft 810. The contact end 804 connects with a leveling member that is capable of rotating around the contact end 804. When the shaft 810 is operated, the leveling member 802 attempts to apply an even pressure against another structure in contact. The shaft 810 engages with the extension part 814 via a tubular member 808 attached to the extension part 814 via a plurality of screws or rivets 806. Both the shaft 810 and the tubular member 808 are threaded so that they can move relative to each other. According to an embodiment, the tubular member 808 is a nut.

Figure 9:
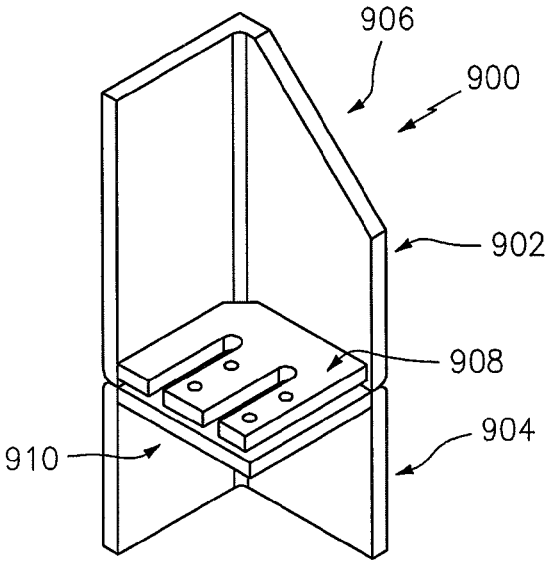
FIG. 9 illustrates a corner rail according to an embodiment of the present application.

FIG. 9 illustrates a supplemental segment 900 according to an embodiment of the present application. The supplemental segment 900 may be a corner rail that is attached to an end of a longitudinal rail or an end rail. In an application, the supplemental segment 900 may be used to make the rails be adaptive to openings with irregular shapes. According to an embodiment, the supplemental segment 900 includes an end portion 902 and a middle portion 904. The middle portion 904 may be removable from the supplemental segment 900, thus making the length of the supplemental segment 900 adjustable.

The end portion 902 may be beveled at the part 906 where the end portion meets with another one. The end portion also includes an attachment rib 908 that has at least one opening used to accommodate an attachment member such as a bolt. The middle portion 904 also includes a rib 910 that has a similar function as that of the rib 908.

Figure 10:
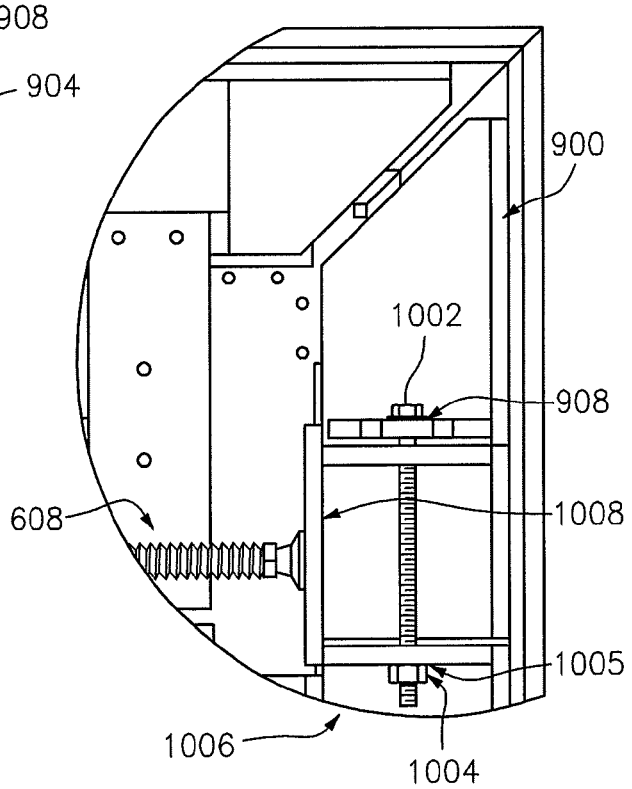
FIG. 10 illustrates an attachment between a corner rail and another rail according to an embodiment of the present application.

FIG. 10 illustrates a configuration of a corner of a frame structure wherein a supplemental segment 900 is attached to a rail 1006 according to an embodiment of the present application. A bolt 1002 and a nut 1004 secure the supplemental segment 900 with the rail 1006 via the rib 908 and the rib 1006. To apply pressure evenly across both the supplemental segment 900 and the rail 1006, the pressing member 608 presses both the corner rail and the rail via a pressing plate 1008. The pressing plate 1008 has adequate length to cover both segments and has adequate stiffness to distribute the pressure of the pressing member 608 evenly.

Figure 11:
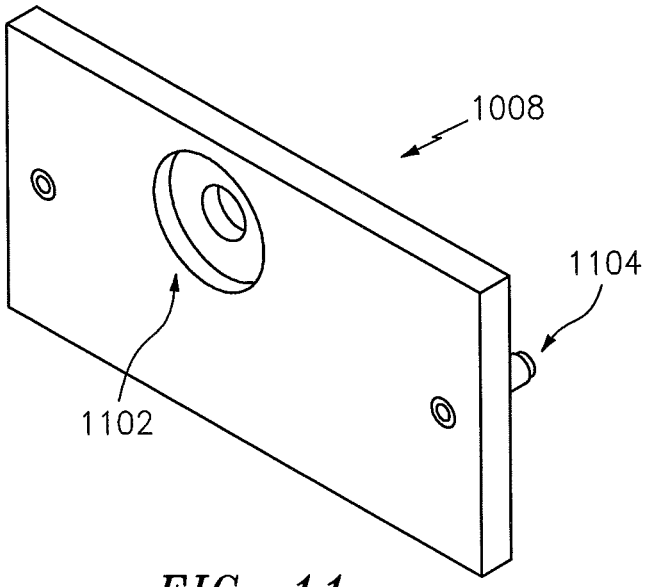
FIG. 11 illustrates a pushing plate according to an embodiment of the present plate.

FIG. 11 illustrates the pressing plate 1008 according to an embodiment of the present application. The pressing plate 1008 includes a depression 1102 and a plurality of protrusions 1104. The pressing plate 1008 has a length that covers both the corner rail and the rail. The protrusions restrict the parallel movement of the pressing plate when the pressing member 608 engages with the pressing plate. The depression 1102 has a similar shape with the leveling member 804 of the pressing member 608.

Figure 12:
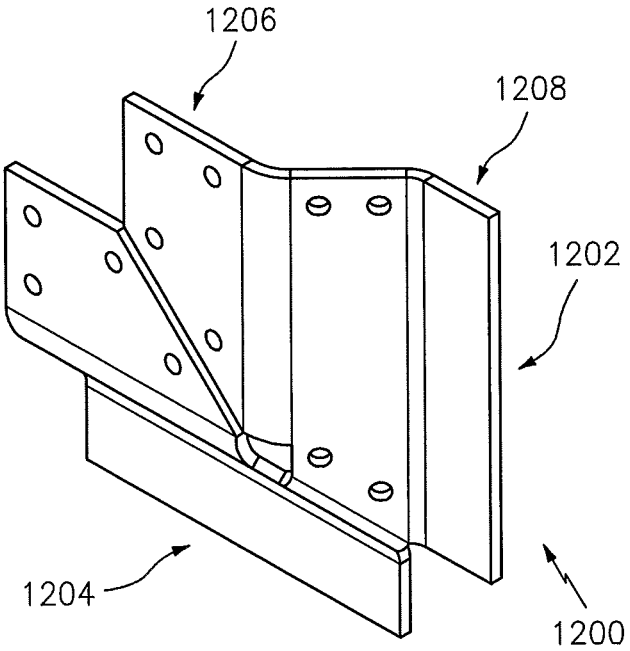
FIG. 12 illustrates a corner plate according to an embodiment of the present application.

FIG. 12 illustrates a corner plate according to an embodiment of the present application. The corner plate 1200 may be used to reinforce the corner of the frame structure where two rails meet with each other. The corer plate may further be used to cover gaps formed between those two rails and provide a wider contract area with the panel 200. The corner plate has a general "L" shape characterized by a first side 1202 and a second side 1204, wherein the first side and the second side are perpendicular to each other. Both sides 1202 or 1204 are attached to the rails. The corner plate 1206 also has a step like configuration, wherein the portion 1206 and the portion 1208 are offset from each other by a predetermined distance corresponding to the thickness of a surface plate of the rails. The offset between portions 1206 and 1208 is set so that when the portion 1208 is placed under a rail, the portion 1206 flushes with the top surface of that rail.

Figure 13:
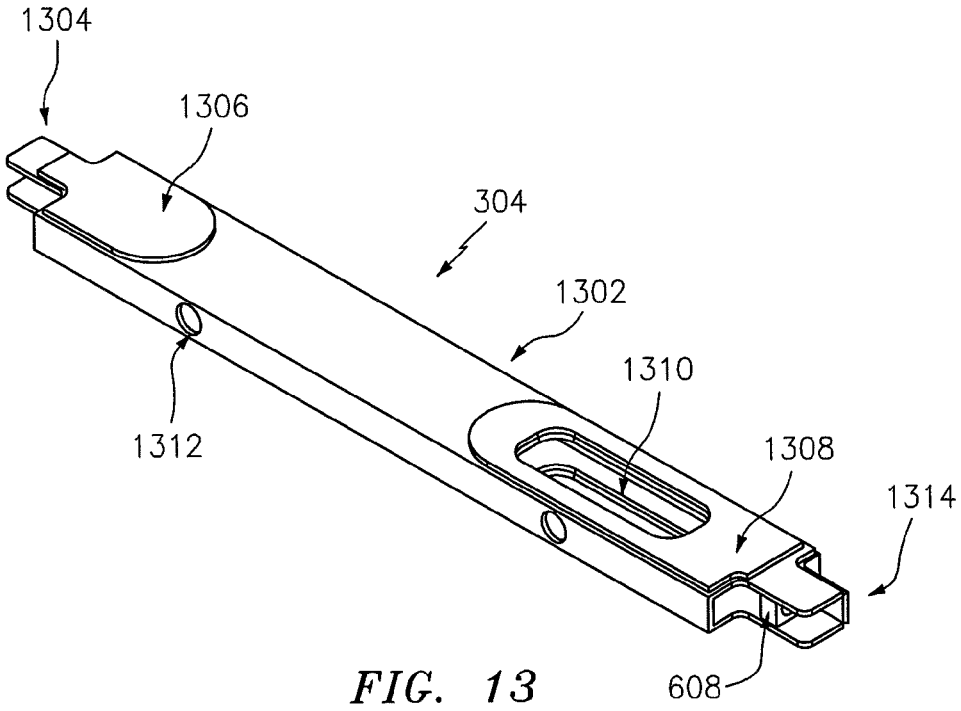
FIG. 13 illustrates a cross bar according to an embodiment of the present application.

FIG. 13 illustrates a cross bar 304 according to an embodiment of the present application. According to an embodiment, the cross bar 304 represents a tubular member with a center body 1302 and two tongues 1304 and 1314. The center body 1302 supports the panel 200 via the plurality of support members 208 as shown in FIG. 2. The two tongues 1304 and 1314 may be inserted into the rails 310 or 308. The cross bar 304 also includes at least one pressing member 608 capable of extending though any one of the tongues 1304 and 1314. As both the tongue 1304 and 1314 directly contact with the rails, reinforcement members 1306 and 1308 are placed at both tongues. The center body 1302 further includes an opening 1310 providing access to the pressing member 608 inside the cross bar 1300. The cross bar 304 also includes a plurality of openings at the bottom. These openings are used to provide engagement locations to the toggle clamps 206 and 204.

Figure 14:
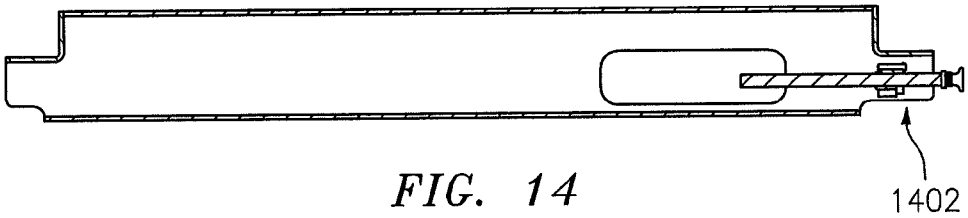
FIG. 14 illustrates a fixture mechanism of a cross bar according to an embodiment of the present application.

FIG. 14 illustrates a pressing member 1402 inside the cross bar 304 according to an embodiment of the present application. The pressing member 1402 may have a similar configuration as the pressing member 608 shown in FIG. 8.

Figure 15:
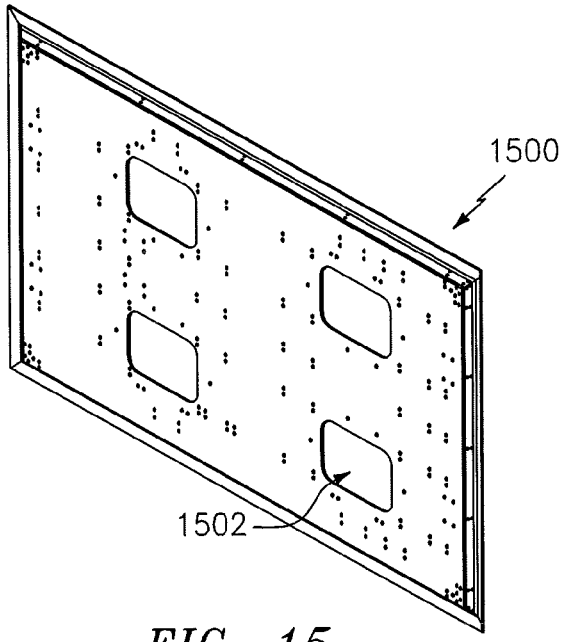
FIG. 15 illustrates a surface plate of the cover panel according to an embodiment of the present application.

FIG. 15 illustrates a surface plate according to an embodiment of the present application. The surface plate 1500 includes a plurality of openings 1502 that provide access to components inside a panel. According to an embodiment, an installer of the cover system may use the openings 1502 to access toggle clamps inside the panel. According to an embodiment, each of the openings 1502 is covered by a lid and a seal gasket, which is sandwiched between the lid and the surface plate to form a water tight seal. The surface plate 1500 is preferably made of one piece of a metal plate that is bent in the corners to have suitable waterproof features and mechanical strength.

Figure 16:
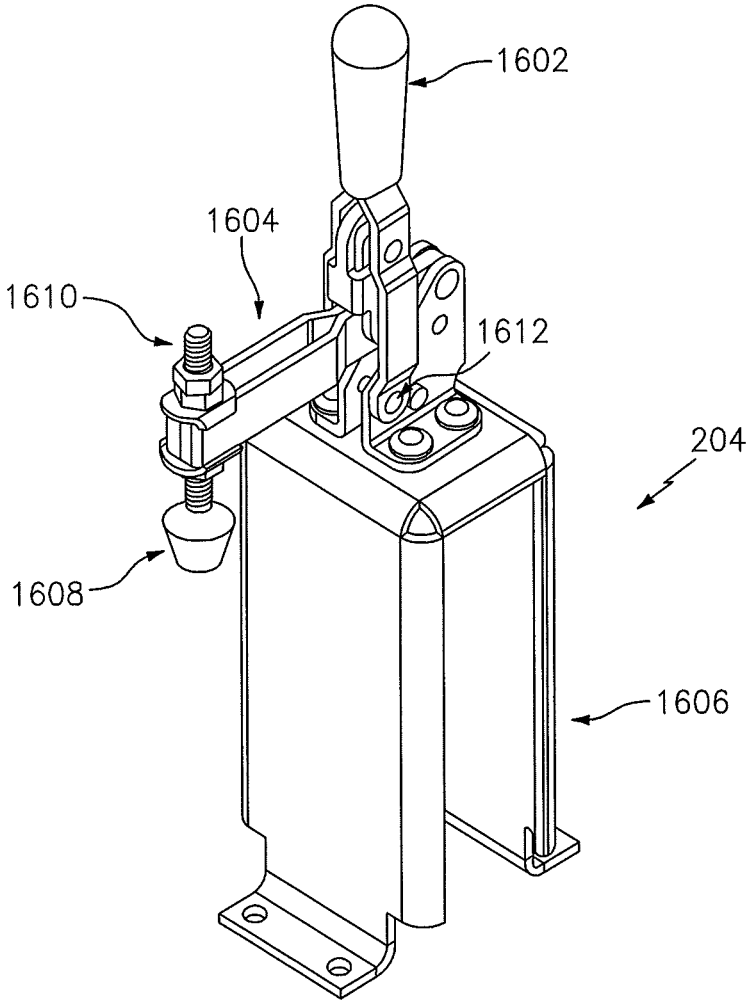
FIG. 16 illustrates a toggle clamp according to embodiment of the present application.

FIG. 16 illustrates an engagement member 204 according to an embodiment of the present application. The engagement member may be implemented as a toggle clamp which includes a toggle part 1610 attached to a base 1606. The toggle part 1610 may include an engagement tip 1608, a handle 1602, and a lever 1604. The handle 1602 is pivotally rotatable around a pin 1612, which engages or disengages the tip 1608 with the cross bars 304. The toggle part 1602 may use any commercially available one, such as toggle clamps made by Rockler. The base 1606 is attached to the surface plate of a panel. The height of the base 1606 is configured based on the height of the support member 08 and the cross bars 304 such that when the toggle clamp 204 is in an engagement position, the engagement member 1608 firmly engages with a cross bar adjacent to the toggle clamp 204. The tip 1608 is attached to the level by a bolt 1610, which allows the relative position between the tip 1608 and the lever 1604 to be adjustable.

Figure 17:
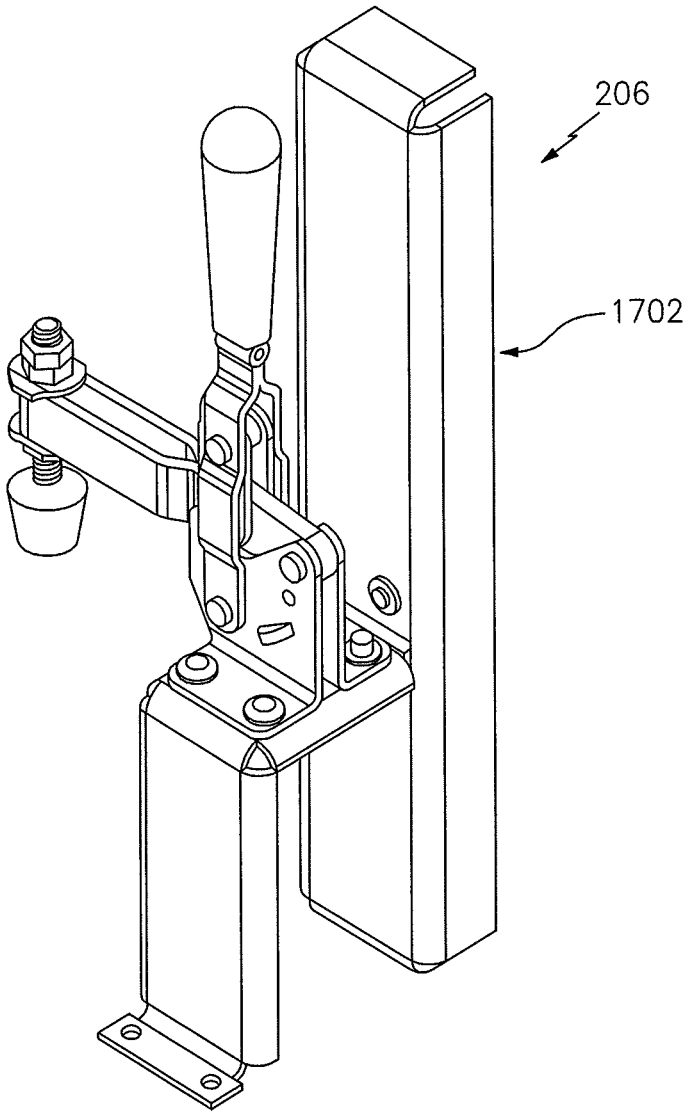
FIG. 17 illustrates a toggle clamp according to an embodiment of the present application.

FIG. 17 illustrates an embodiment of a toggle clamp 206 according to an embodiment of the present application. The toggle clamp 206 may be used to support the panel. The toggle clamp 206 is similar as that of the toggle clamp 204 as shown in FIG. 16 except that the base includes a longer leg 1702. The length of the leg 1702 is configured to be not shorter than the total height of the toggle part and the base. Thus, when the toggle clamp 206 is used to support the panel, the handle of the toggle part will not be damaged.

Figure 18A:
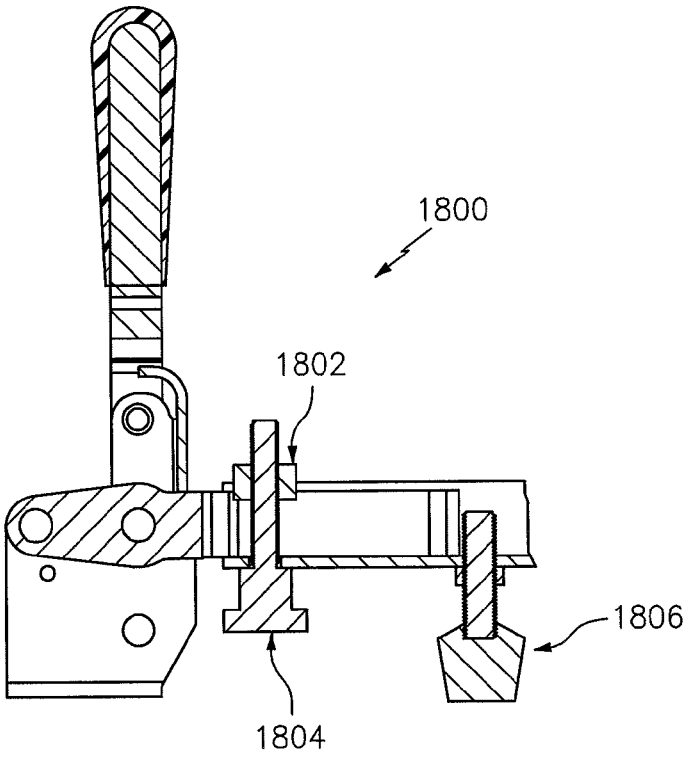
FIG. 18(*a*) illustrates a configuration of a toggle clamp according to an embodiment of the present application.
Figure 18B:
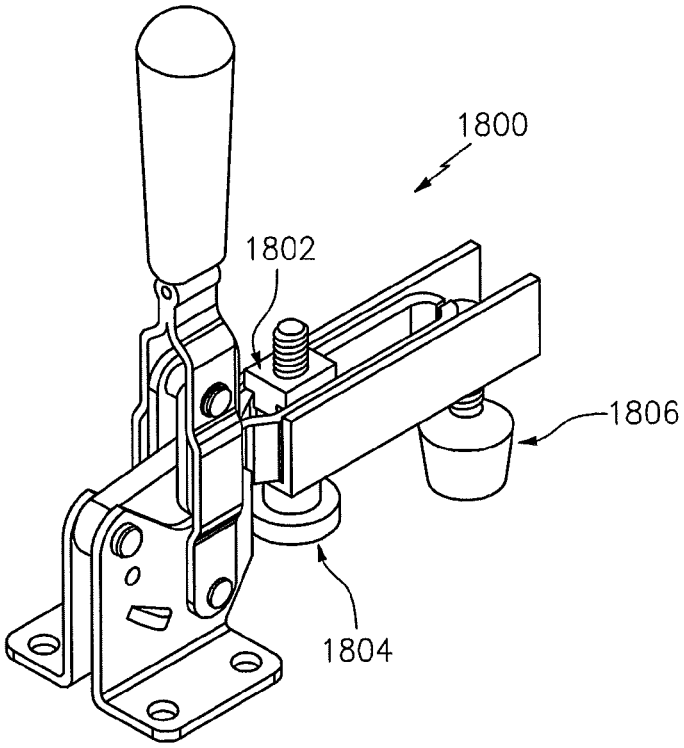

FIGS. 18(*a*) and (*b*) illustrate an embodiment of a toggle part. The toggle part 1800 includes an engagement tip 1806, whose height is adjustable. The toggle part 1800 further includes another adjustable tip 1804 attached to the lever via a nut 1802. This additional tip 1804 may provide further engaging force between the clamp and the cross bars.

The cover system and components may be made of any suitable material that provides the required structural strength and satisfies use and environmental constraints, including aluminum, metal alloy, stainless steel, composites, plastic, etc. According to one embodiment, the panel, rails, and cross bars are made of an aluminum alloy, such as Alloy 6061-T6 or 5052-H4.

Figure 19A:
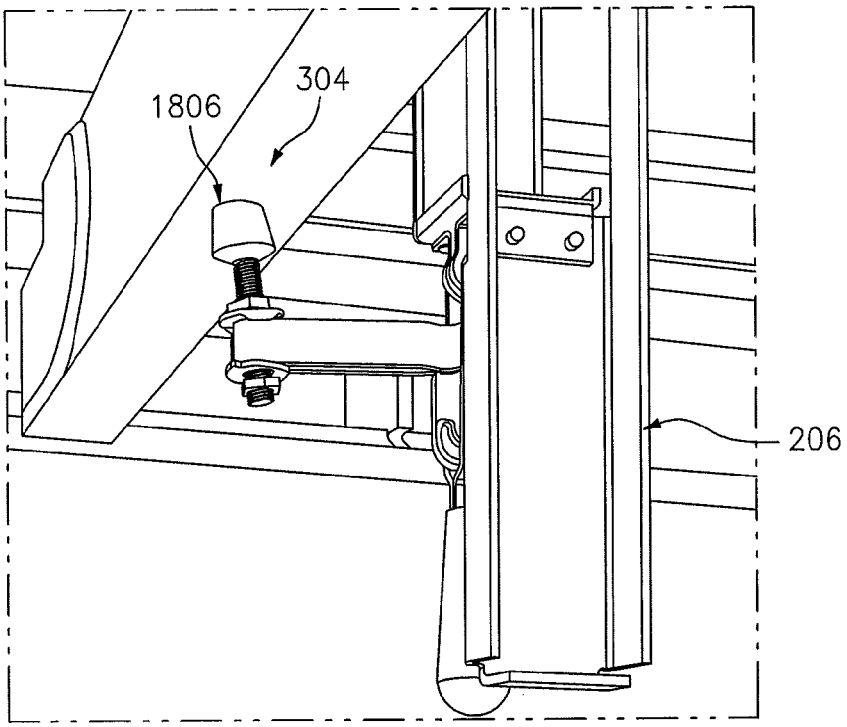
FIG. 19(*a*) illustrates an engagement between a toggle clamp and a cross bar according to an embodiment of the present application.
Figure 19B:
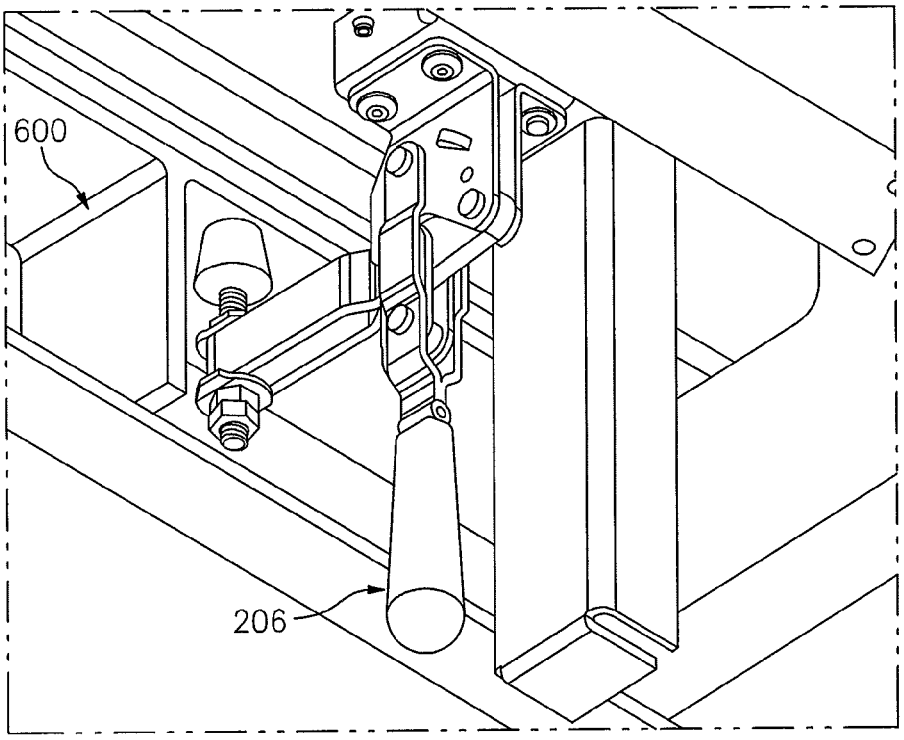

FIG. 19(*a*) illustrates a toggle clamp engaging a cross bar according to an embodiment of the present application. The toggle clamp such as those clamps 206 in FIG. 2 is attached to a surface plate and extends beyond the bottom of the cross bar 304. The engagement tip 1806 is configured to contact the bottom of the cross bar 304 such that the panel is secured to the frame structure of the cover system. FIG. 19(*b*) illustrates a toggle clamp engaging a rail according to an embodiment of the present application. In addition to cross bars, a toggle clamp, such as the toggle clamp 206, may engage a rail 600. The toggle clamp may engage a top plate of the rail as shown in FIG. 19(*b*) or engage the bottom of the rail 600.

Figure 20:
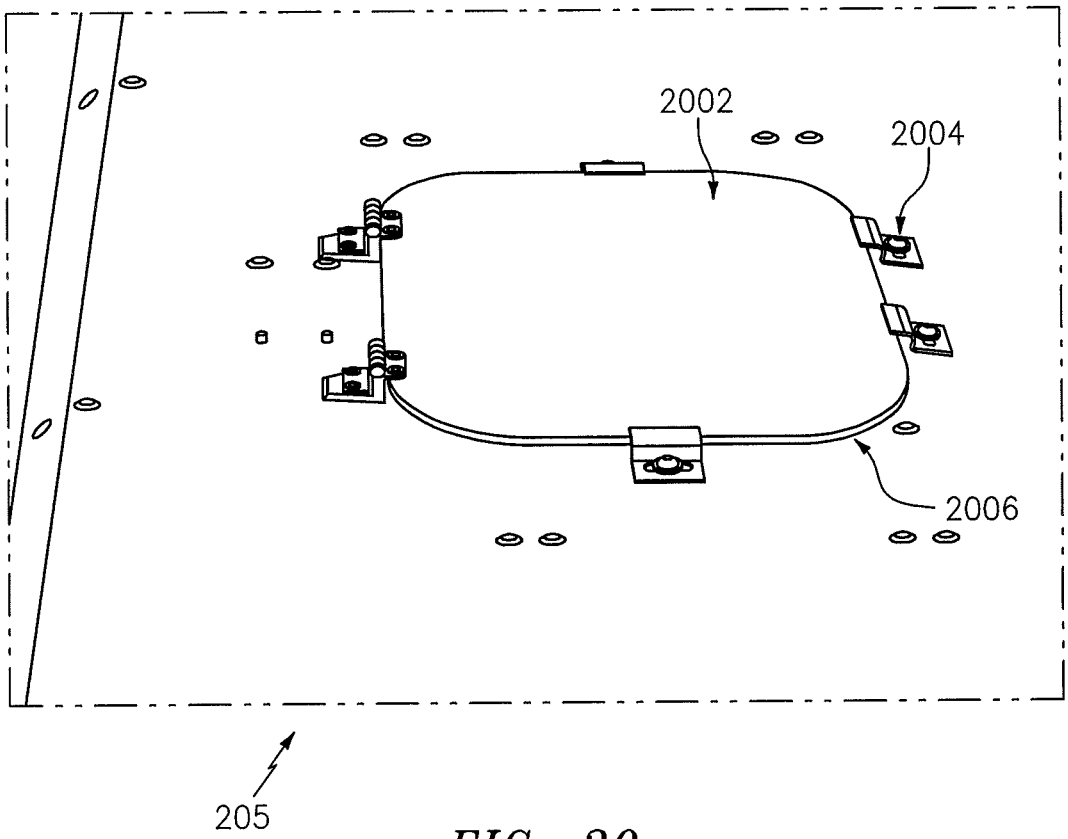
FIG. 20 illustrates a lid of a cover system according to an embodiment of the present application.

FIG. 20 illustrates a lid that covers an opening 210 of the panel 200 according to an embodiment of the present application. The lid or hatch 2002 is secured to the panel 200 by a plurality of clamps 2004. A seal gasket 2006 is placed between the hatch 2002 and the surface plate of the panel 200 to form a water tight seal.

The particular embodiments disclosed above are illustrative only, as the invention may be modified and practiced in different but equivalent manners apparent to those skilled in the art having the benefit of the teachings herein. Furthermore, no limitations are intended to the details of construction or design herein shown, other than as described in the claims below. It is therefore evident that the particular embodiments disclosed above may be altered or modified and all such variations are considered within the scope and spirit of the invention. Although illustrative embodiments of the invention have been described in detail herein with reference to the accompanying drawings, it is to be understood that the invention is not limited to those precise embodiments, and that various changes and modifications can be effected therein by one skilled in the art without departing from the scope and spirit of the invention as defined by the appended claims.

What is claimed is:

1. A cover system for covering an entrance of an underground structure, comprising:

a panel;

a frame structure having a plurality of protrusions that slidably engage a plurality of receptacles of the entrance, wherein a first gap is formed between the panel and the frame structure, and a second gap is formed between the frame structure and the entrance; and a seal gasket of a single piece configured to seal both first and second gaps between the frame structure and the entrance and between the frame structure and the panel of the cover system, wherein the panel further includes a plurality of engagement members that engage the frame structure, and wherein the entrance represents an entrance that allows a worker to enter a subway tunnel.

2. The cover system of claim 1, wherein the panel includes a plurality of openings that provide access to the engagement members.

3. The cover system of claim 2, wherein each opening is covered by a lid with a seal gasket.

4. The cover system of claim 1, wherein the frame structure includes a plurality of rails with protrusions adapted to be inserted into receptacles in the foundation.

5. The cover system of claim 4, wherein the protrusions are detachable from the rails.

6. The cover system of claim 4, wherein the frame structure further includes a plurality of corner rails.

7. The cover system of claim 4, wherein the frame structure further includes a plurality of cross bars, each having a pressing member for pushing a corresponding rail against a foundation of the entrance.

8. The cover system of claim 4, wherein at least one rail includes a pressing member that pushes an adjacent rail against the foundation.

9. The cover system of claim 1, wherein the engagement member includes a toggle clamp.

10. The cover system of claim 9, wherein the toggle clamp includes a toggle part attached to a base that is attached to a surface plate of the panel.

11. The cover system of claim 10, wherein at least one toggle clamp includes a leg extending beyond a height of the toggle part.

12. The cover system of claim 1, wherein the seal gasket includes two angled flaps.

* * * * *